US007143627B2

(12) United States Patent
Akins

(10) Patent No.: US 7,143,627 B2
(45) **Date of Patent: *Dec. 5, 2006**

(54) APPARATUS AND METHOD FOR REMOVING DENTS FROM METAL

(75) Inventor: James M. Akins, 5113 Glenaire Dr., Dublin, OH (US) 43017

(73) Assignee: James M. Akins, Dublin, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/138,057

(22) Filed: May 26, 2005

(65) Prior Publication Data

US 2006/0016239 A1 Jan. 26, 2006

Related U.S. Application Data

(63) Continuation of application No. 10/108,533, filed on Mar. 27, 2002, now Pat. No. 6,923,031, which is a continuation-in-part of application No. 10/033,095, filed on Oct. 22, 2001, now abandoned.

(51) Int. Cl.
*B21J 15/24* (2006.01)

(52) U.S. Cl. ..... 72/430; 72/705; 72/707

(58) Field of Classification Search ..... 72/56, 72/75, 430, 705, 707; 29/90.01
See application file for complete search history.

(56) References Cited

U.S. PATENT DOCUMENTS 2,441,517 A * 5/1948 Sussman ..... 72/430
4,252,008 A * 2/1981 Dibbens ..... 72/56
4,495,791 A 1/1985 Kemnitz et al.
4,727,744 A 3/1988 Ferree
4,727,745 A 3/1988 Ferree
4,753,104 A 6/1988 Strozier
4,754,637 A 7/1988 O'Dell
5,203,196 A 4/1993 Jenkins
5,205,150 A 4/1993 Nyffeler
5,727,418 A 3/1998 Strozier
5,730,023 A 3/1998 Gmeilnauer
6,014,885 A 1/2000 Griffaton
6,669,024 B1 * 12/2003 Ottens ..... 209/215

* cited by examiner

*Primary Examiner*—Ed Tolan
(74) *Attorney, Agent, or Firm*—Calfee, Halter & Griswold LLP

(57) ABSTRACT

A system for removing dents from metal or other materials comprising (i) a device which includes at least one magnet having a handle detachably held to a portion of the magnet by magnetic attraction and a roller detachably held to a portion of the magnet opposite the handle by the magnetic forces of the magnet; and (ii) a method which includes the steps of attaching the magnet to the handle, placing the roller inside the tubing of a dented instrument, placing the portion of the magnet opposite the handle against the exterior of the instrument, catching or acquiring the roller with the magnet such that the magnet and the roller form a magnetic assembly, wherein the roller is on the interior of the instrument and the magnet is on the exterior of the instrument, and moving, sliding, or rocking the magnetic assembly across the dents until the dents are removed from the metal.

8 Claims, 4 Drawing Sheets

APPARATUS AND METHOD FOR REMOVING DENTS FROM METAL

CROSS REFERENCE TO RELATED APPLICATIONS

This patent application is a continuation of U.S. patent application Ser. No. 10/108,533, filed Mar. 27, 2002, now U.S. Pat. No. 6,923,031 which is a continuation-in-part of U.S. patent application Ser. No. 10/033,095, filed Oct. 22, 2001 now abandoned.

STATEMENT REGARDING FEDERALLY SPONSORED R & D

This invention was not made by an agency of the United States Government nor under contract with an agency of the United States Government.

TECHNICAL FIELD

This invention relates generally to a system for removing dents from metal or other materials, and specifically to an apparatus and method for removing dents from the metal of certain musical instruments and other metal or metallic objects of flat or tubular construction.

BACKGROUND OF INVENTION

Musical instruments that are constructed from a relatively soft metal such as brass are particularly susceptible to denting when not handled carefully. Brass instruments such as tubas, sousaphones, French horns, and timpani tend to be expensive, complex devices and denting frequently results in damage that diminishes the sound quality, appearance, and value of the instrument.

Currently known dent removal systems which are used for musical instruments such as tubas and sousaphones typically require (i) disassembling the instrument by means of torch-heating soldered joints; (ii) removing the damaged part of the instrument; and (iii) and pounding out the dent by utilizing an appropriate backing surface, usually a shaped piece of steel at the end of a rod, and various types of hammers. Processes of this nature are problematic because they are laborious, time-consuming, and only partially effective. Heating the metal of a musical instrument to the temperature at which solder melts is also likely to damage the lacquered protective finish of the instrument. Furthermore, some musical instruments are plated with silver, and if melted solder runs out of a joint between sections of the instrument, the silver finish will be destroyed if the hot solder comes into contact with the finish.

Another problem associated with commonly used dent removal methods is the damage the hammering process can cause to the metal of the instrument. Repeated hammering of the metal actually thins the metal because as the hammer strikes the surface of the metal, the metal is compressed against the backing surface. The result is significantly weakened metal that is even more susceptible to dents, crack, or punctures. Furthermore, the appearance of a damaged instrument repaired with conventional methods is never truly restored to its pre-damaged state, as some evidence of the repair is always visible on the surface of the instrument.

The tubular portions of some musical instruments are formed from a single sheet of brass that is rolled and notched along the sides of the sheet that contact one another. These notches are then finger-lapped together and brazed to form a tube. Conventional dent repair hammering processes readily damage this type of running joint, making even more extensive repairs a distinct possibility.

Finally, the time required and expense involved with conventional dent repair methods creates additional problems for instrument owners. A tuba with dents covering the bottom branch and the next branch of the instrument can be out of service for months and repairs may cost thousands of dollars per instrument. Thus, a high school band, orchestra, or professional symphony with multiple instruments in need of repair can quickly incur tens of thousands of dollars in expenses each time instrument repairs are undertaken. Therefore, there is a need for a quick, effective, inexpensive, and non-damaging system for removing dents from the metal of musical instruments and from other metals.

SUMMARY OF INVENTION

These and other limitations of the prior art are overcome by the present invention which provides a system for quickly and effectively removing dents from metal surfaces. A preferred embodiment this invention includes both a device and a method for removing dents from metal, and metal tubing in particular. A preferred embodiment of this invention may be used with musical instruments such as tubas, sousaphone, and timpani, all of which are typically made from brass of varying degrees of thickness. The preferred embodiment may also be used to remove dents from other metal surfaces such as motorcycle gas tanks and exhaust pipes, as well as the various metal surfaces of automobiles and other vehicles.

In the broadest sense, the apparatus or device component of the present invention includes; preferably, (i) at least one disc-shaped magnet having a handle detachably held to a one face of the magnetic disc by magnetic attraction, and (ii) a roller detachably held to the face of the magnetic disc opposite the handle by the magnetic forces of the disc. Preferably, the apparatus or device component of the present invention is used by a method that includes the steps of attaching the magnet to the handle, placing the roller inside the tubing of a dented instrument or other metal object, placing the face of the disc opposite the handle against the exterior of the instrument, catching or acquiring the roller with the magnet such that the magnet and the roller form a magnetic assembly, wherein the roller is on the interior of the instrument and the magnet is on the exterior of the instrument, and moving, sliding, or rocking the magnetic assembly across the dents until the dents are removed from the metal.

Further advantages of the present invention will become apparent to those of ordinary skill in the art upon reading and understanding the following detailed description of the preferred embodiments.

BRIEF DESCRIPTION OF THE DRAWINGS

In FIG. 3, the roller is shown inside the tubing of the instrument.

DETAILED DESCRIPTION OF THE INVENTION

Figure 1A:
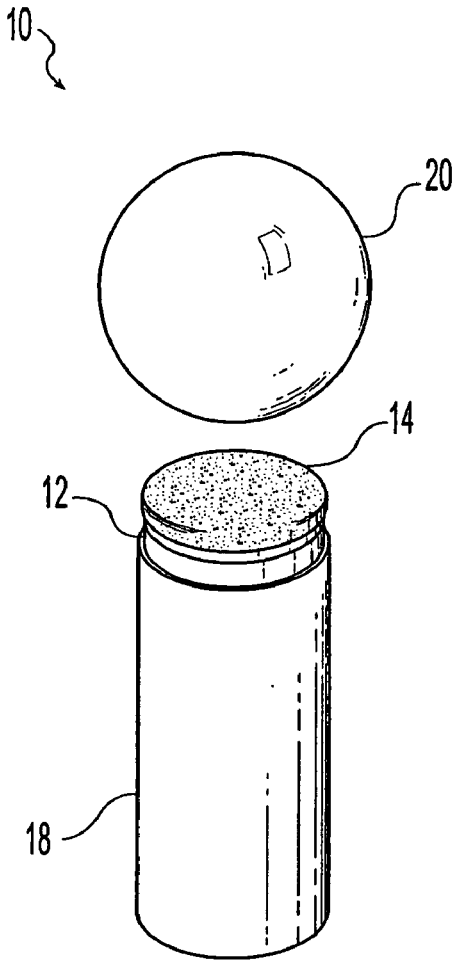
FIG. 1*a* is a front view the magnetic assembly of the present invention showing the handle grip in place on the steel handle and the protective cover in place on the magnet.
Figure 1B:
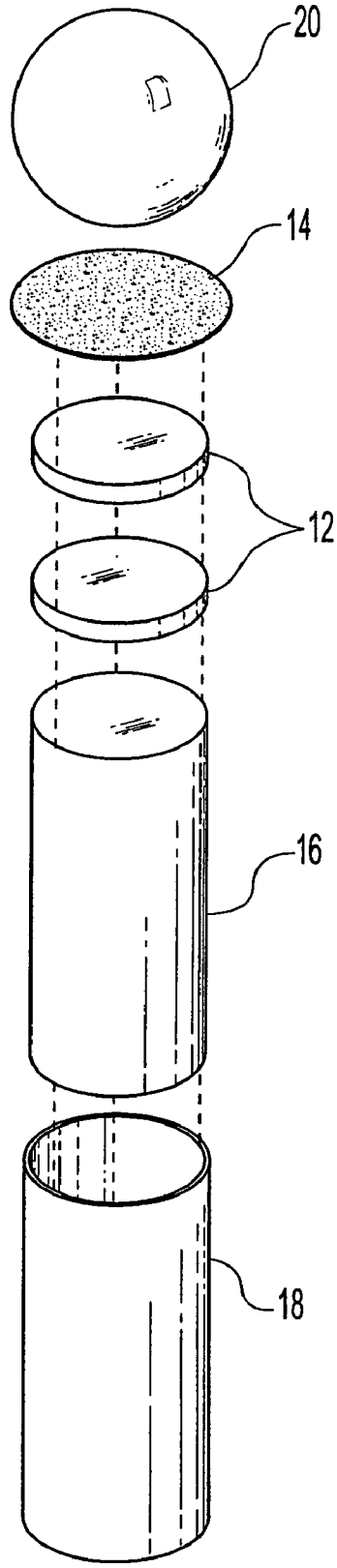
FIG. 1*b* is an exploded view of the magnetic assembly of FIG. 1*a* showing the spatial relationship of the various components relative to one another and depicting the preferred placement of the magnets when more than one magnet is utilized.

The present invention provides an apparatus or device and method for removing dents from metal. While this device and method are useful for a variety of metals such as steel, aluminum, and tin, a preferred embodiment of this invention is particularly useful for removing dents from musical instruments constructed of brass or metal alloys containing brass or other relatively soft metals. The present invention does not require disassembly of the instrument to be repaired and in most cases causes virtually no visually perceptible damage to the metal from which the dent has been removed. As shown in FIGS. 1*a* and 1*b*, a preferred embodiment of the device component of the present invention includes magnetic assembly 10 which further includes at least one disc-shaped magnet 12, protective cover 14, handle 16, handle grip 18, and roller 20.

In the embodiment shown in FIG. 1*a*, handle grip 18 has been placed around handle 16 to provide the user of the device with increased grip and control. Preferably, handle grip 18 is plastic, although rubber, leather, and other similar materials may be used for handle grip 18. In a preferred embodiment, handle 16 is about 4.5 inches (11.43 cm) in length, about 2 inches (5.08 cm) in diameter, is manufactured from cold-rolled, high carbon steel, and is cylindrical in shape to correspond to the shape of magnet 12. Presumably, handle 16 has the effect of focusing the pull of magnet 12 when handle 16 is attached to magnet 12. In a preferred embodiment, magnet 12 is removably attached to or held against handle 16 by the magnetic forces of magnet 12. In alternate embodiments, handle 12 is a variety of lengths and diameters so to accommodate a variety of different magnets. Handle 12 may be manufactured from any metal having characteristics that focus or enhance the efficiency, pull, or strength of magnet 12 or which simply make magnet 12 easier to handle and manipulate. Preferably, handle 12 is simply an elongated cylinder, although other shapes such as a hand-adapted grip are possible. In one embodiment, magnet 12 is used without handle 16. In another embodiment, magnet 12 is integrated into handle 12 and is not detachable.

Although a variety of magnet types, shapes, and sizes are compatible with the system of the present invention, preferably, magnet 12 is a disc-shaped neodymium magnet (neomagnet) having a diameter of about 2 inches (5.08 cm), a thickness of about 0.5 inches (1.27 cm), and a grade or rating of about 30 to 45 T (30,000 to 45,000 gauss; available from AEC Magnetics, Cincinnati, Ohio, product no. H-4162). Although a grade of about 30 to 45 T is preferred, magnets in the range of about 10 to 90 T (10,000 to 90,000 gauss) are also compatible with this invention.

While a single magnet 12 produces sufficient pull on roller 20 to remove dents from the metal of most brass musical instruments, additional disc-shaped magnets may be stacked on top of one another to provide increased pull for other applications. Increased pull may be required to remove dents from brass instruments having metal of greater thickness than that of a tuba or sousaphone, or to remove dents from other types of metal. Although the disc shape is preferred, magnet 12 may be manufactured in a variety of shapes. In one embodiment, magnet 12 is tapered such that the portion of the magnet that contacts the metal is smaller in diameter than the portion of the magnet attached to the handle. When removing small dents, a tapered magnet will presumably provide greater control to the user of the device, thereby increasing the overall accuracy and ease of the dent removal process.

As shown in FIG. 1*a*, protective cover 14 is attached to the face of magnet 12 that contacts the metal surface from which a dent is to be removed. Protective cover 14 reduces the likelihood magnet 12 will scratch or otherwise damage the surface of the metal from which a dent is being removed. Preferably, protective cover 14 is felt with an adhesive backing; however, any soft, non-scratching material attachable to magnet 12 is suitable for use as protective cover 14.

Roller 20 removes the dents from metal by rolling the dents out. In the embodiment shown in FIGS. 1*a*, 1*b*, and 2, roller 20 is a chrome ball bearing. Such ball bearings are made of steel, and are magnetically attracted to the pull of magnet 12. In embodiments where roller 20 is a ball bearing, ball bearings of various sizes may be used. In the case of musical instruments, the size of the ball bearing required to remove dents is determinable by the diameter of the tube into which the ball bearing is inserted. For example, a larger ball bearing (e.g., 1.75 inches (4.45 cm) in diameter) may be appropriate for a tuba, while a smaller ball bearing (e.g., 1.0 inch (2.54 cm) in diameter) may be appropriate for a trombone. In alternate embodiments, roller 20 is cylindical, oblong, or other shapes suitable to the object or surface from which dents are being removed. Roller 20 may be manufactured from any material that is magnetically attracted to magnet 12 to the degree or extent necessary to remove dents from a metal surface.

Figure 4:
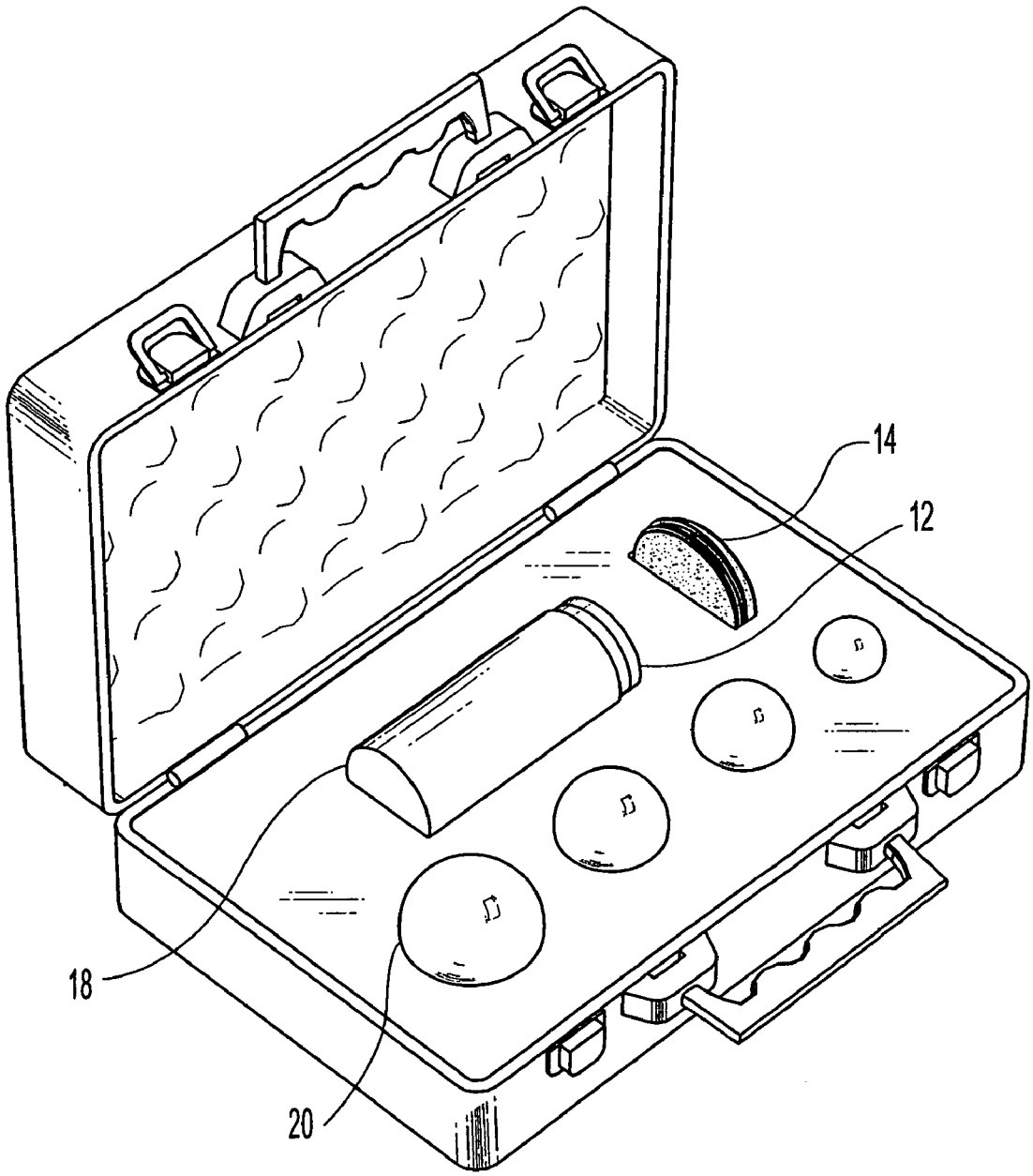
FIG. 4 illustrates the apparatus or device of the present invention packaged into a kit that provides the user of the device with the handle, handle cover, magnet, protective covers for the magnet, four differently sized rollers, and a convenient hard-shell carrying case that includes protective interior padding to prevent the components of the kit from being damaged.

As shown in FIG. 4, magnetic assembly 10 may be provided as part of a portable kit for removing dents from metal. Preferably, this kit includes at least one disc-shaped neomagnet 12, a steel handle 16, at least one roller 20, and a hard shell case having a cutaway foam lining for holding the contents of the kit. Other preferred kit components include at least one handle grip 18, at least one protective cover 14, and instructions for how to use the contents of the kit. Preferably, roller 20 is a steel ball bearing. Additional rollers of various sizes and shapes may also be included in the kit. For example, ball bearings having diameters of 2.5 inches (6.35 cm), 1.75 inches (4.45 cm), 1.25 inches (3.18 cm), and 1.0 inch (2.54 cm) may be included. Another embodiment of the kit includes a container of metal polish for use on the surfaces from which dents are removed.

Figure 3:
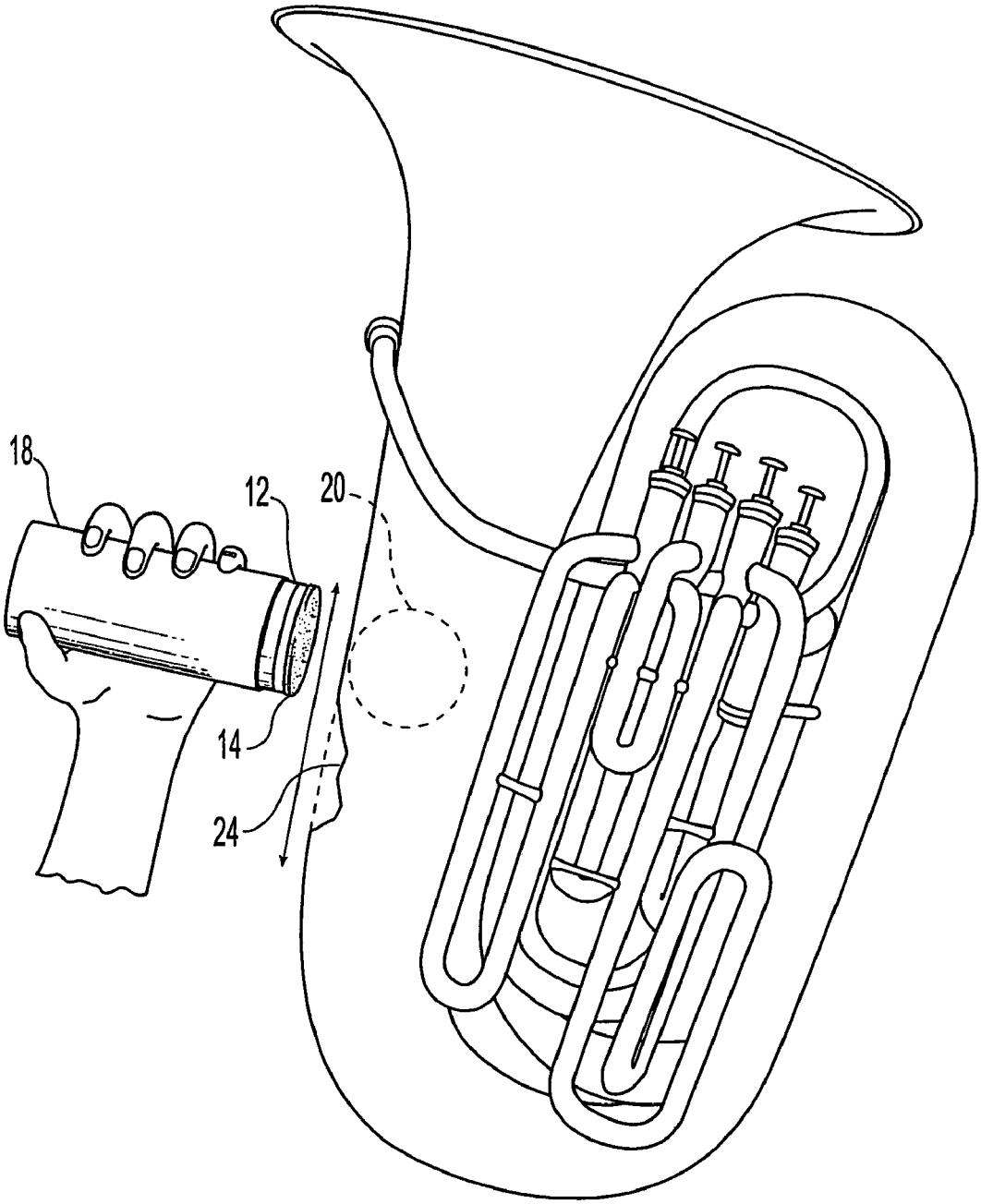
FIG. 3 illustrates the magnetic assembly of FIG. 1*a* removing a dent from the metal tubing of a musical instrument by applying back and forth motions of the magnetic assembly over a dented area.

With reference to FIG. 3, magnetic assembly 10 is used according to the following preferred method: (i) attach magnet 12 to handle 16; (ii) place a roller 20 inside the tubing 22 of a dented instrument; (iii) place the face or portion of magnet 12 opposite handle 16 against the exterior of the instrument; (iv) catch or acquire roller 20 with magnet 12 such that magnet 12 and the roller 20 form a magnetic assembly 10, wherein roller 20 is on the interior of the instrument and magnet 12 is on the exterior of the instrument; and (v) move, slide, or rock magnetic assembly 10 across dents 24 until the dents are removed from the metal. This preferred method may also include the step of attaching protective cover 14 to the face of magnet 12 opposite handle 16, and the step of placing handle grip 18 around handle 16.

Figure 2:
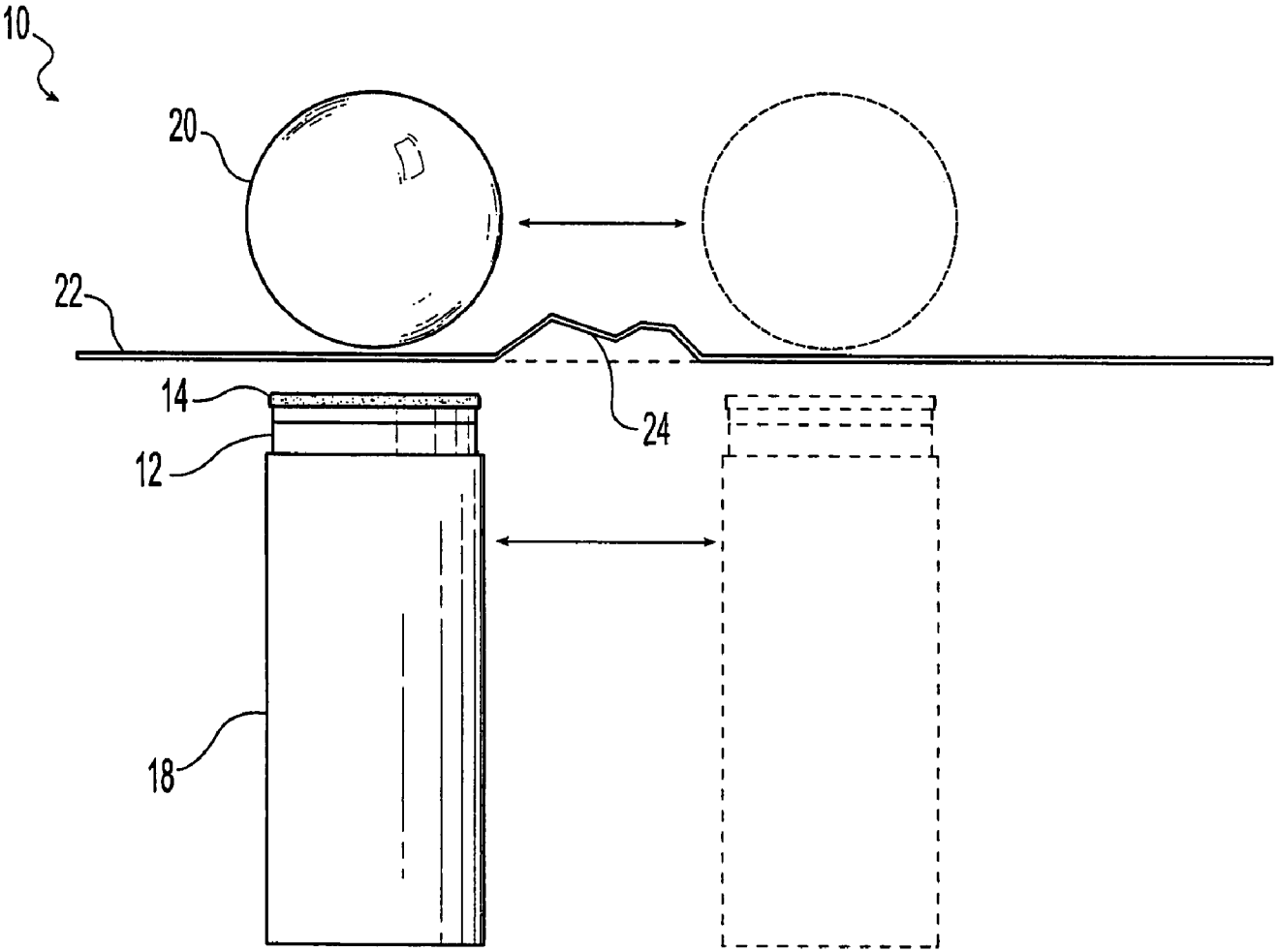
FIG. 2 illustrates the magnetic assembly of FIG. 1*a* removing a dent from a flat metal surface by applying back and forth motions of the magnetic assembly over a dented area.

A variant of the method described above may be applied to other metal surfaces for the purpose of removing dents. As shown in FIG. 2, an alternate method for removing a dent from metal or another two-sided material includes the steps of (i) placing magnet 12 on the inwardly dented side of the metal or other material; (ii) placing roller 20 on the outwardly dented side of the metal or other material; (iii) bringing magnet 20 into the proximity of roller 20 such that the roller and magnet form magnetic assembly 10; and (iv) moving magnetic assembly 10 back and forth across dent 24 until the dent is removed. Adding handle 16 to magnet 12 prior to use of the device greatly increases both the effectiveness of the magnetic assembly and the use of use of the apparatus. This general method of using the present invention can be applied to any and all metals or metal surfaces provided that the thickness of the metal does not significantly interfere with the magnetic interaction between roller 20 and magnet 12.

As discussed, the present invention is an extremely effective tool in removing the dents from certain types of musical instruments. This invention may also be used to remove dents from other metal constructs or any other type of material where the magnetic interaction of roller 20 and magnet 12 is sufficient for, and the contour of the surface is conducive to, the effective use of magnetic assembly 10. If necessary, the dimensions of the preferred embodiment may be altered or tailored for specific applications such as the repair of motorcycle gas tanks and exhaust pipes or the removal of dents from the various surfaces of automobiles. The use of additional magnets in magnetic assembly 10 makes the present invention useful for many types of dent removal applications.

While the above description contains many specificities, these should not be construed as limitations on the scope of the invention, but rather as exemplification of preferred embodiments. Numerous other variations of the present invention are possible, and it is not intended herein to mention all of the possible equivalent forms or ramifications of this invention.

The invention claimed is:

1. A system for removing dents from metal musical instruments, comprising:

(a) a first magnetically responsive member, wherein the first magnetically responsive member further comprises at least one curved surface;

(b) a second magnetically responsive member, wherein the second magnetically responsive member further comprises:

(i) a handle further comprising at least one magnetically responsive metal; and (ii) at least one magnet attachable to the handle; and (c) wherein the first magnetically responsive member is placed on the inside of a metal musical instrument and the second magnetically responsive member is placed on the outside of the musical instrument opposite the first magnetically responsive member to form a magnetic assembly, and wherein the magnetic force of the magnet urges the first magnetically responsive member against the second magnetically responsive member through the metal of the instrument; and (d) wherein a dent is removed from the musical instrument by moving, sliding, or rocking the magnetic assembly across the dent.

2. The system of claim 1, further comprising:

(a) at least one protective cover for covering the portion of the magnet that contacts the exterior of the musical instrument;

(b) instructions for use of the system; and (a) a case for storing the components of the system.

3. The system of claim 1, wherein the handle is contoured to accommodate a human hand.

4. The system of claim 1, wherein the first magnetically responsive member comprises a steel ball bearing, wherein the magnet comprises a neodymium magnet having a rating of about 10 to 90 T, and wherein the handle comprises cold-rolled, high carbon steel.

5. A method for repairing dents in metal musical instruments, the method comprising:

(a) placing a first magnetically responsive member on the inside of a metal musical instrument, wherein the first magnetically responsive member further comprises at least one curved surface;

(b) placing a second magnetically responsive member on the outside of the musical instrument opposite the first magnetically responsive member to form a magnetic assembly, and wherein the second magnetically responsive member further comprises:

(i) a handle, wherein the material of the handle further comprises at least one magnetically responsive metal;

(ii) at least one magnet attachable to the handle;

(iii) wherein the magnetic force of the magnet urges the first magnetically responsive member against the second magnetically responsive member through the metal of the instrument; and (c) repairing the dent by moving, sliding, or rocking the magnetic assembly across the dent.

6. The system of claim 5, wherein the handle is contoured to accommodate a human hand.

7. The system of claim 5, wherein the magnet further comprises a protective cover for covering the portion of the magnet that contacts the exterior of the musical instrument.

8. The system of claim 5, wherein the first magnetically responsive member comprises a steel ball bearing, wherein the magnet comprises a neodymium magnet having a rating of about 10 to 90 T, and wherein the handle comprises cold-rolled, high carbon steel.

* * * * *